US009270063B2

(12) United States Patent
Tang et al.

(10) Patent No.: US 9,270,063 B2
(45) Date of Patent: Feb. 23, 2016

(54) CARD EDGE CONNECTOR WITH DETECTING CONTACTS

(71) Applicant: HON HAI PRECISION INDUSTRY CO., LTD., New Taipei (TW)

(72) Inventors: Wen-Jun Tang, Kunshan (CN); Xue-Wu Bu, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 27 days.

(21) Appl. No.: 14/154,060

(22) Filed: Jan. 13, 2014

(65) Prior Publication Data

US 2014/0199866 A1 Jul. 17, 2014

(30) Foreign Application Priority Data

Jan. 11, 2013 (CN) ..... 2013 1 0010397

(51) Int. Cl.

| | |
|---|---|
| ***H01R 29/00*** | (2006.01) |
| ***H01R 13/717*** | (2006.01) |
| ***H01R 12/70*** | (2011.01) |
| *H01R 12/72* | (2011.01) |

(52) U.S. Cl.

CPC ..... *H01R 13/7175* (2013.01); *H01R 12/7094* (2013.01); *H01R 12/721* (2013.01)

(58) Field of Classification Search

USPC ..... 439/188, 152–160, 488–490, 315, 328

See application file for complete search history.

(56) References Cited

U.S. PATENT DOCUMENTS

| | | | | |
|---|---|---|---|---|
| 5,634,803 | A * | 6/1997 | Cheng et al. | 439/157 |
| 6,126,464 | A | 10/2000 | Chang | |
| 6,174,184 | B1 * | 1/2001 | Meng | 439/188 |
| 7,955,098 | B1 * | 6/2011 | McKee et al. | 439/157 |
| 2002/0076959 | A1 * | 6/2002 | Lee | 439/160 |
| 2008/0026618 | A1 * | 1/2008 | Mon et al. | 439/159 |
| 2011/0124214 | A1 * | 5/2011 | McKee et al. | 439/159 |
| 2012/0058657 | A1 * | 3/2012 | Hu | 439/188 |

FOREIGN PATENT DOCUMENTS

| | | | |
|---|---|---|---|
| CN | 201608313 | U | 10/2010 |
| CN | 102157811 | A | 8/2011 |
| CN | 102480068 | A | 5/2012 |
| TW | M339825 | | 9/2008 |
| TW | M383844 | | 7/2010 |

* cited by examiner

*Primary Examiner* — Abdullah Riyami
*Assistant Examiner* — Harshad Patel
(74) *Attorney, Agent, or Firm* — Wei Te Chung; Ming Chieh Chang

(57) ABSTRACT

A card edge connector for mating with a memory card includes a longitudinal insulative housing, a plurality of contact terminals received in the insulative housing, at least one pair of ejectors and two detect pins having spring and being moveable relatively each other. The ejectors are moveable between locking station and release station. One of the detect pins defines an engaging portion protruding into an inserting slot of the insulative housing for engaging with a bottom edge of the memory card and pushing the detect pins to connect disconnect with each other. Furthermore LED is combined with the detect pins for testing if the memory card is inserted into the connector.

16 Claims, 11 Drawing Sheets

CARD EDGE CONNECTOR WITH DETECTING CONTACTS

BACKGROUND OF THE INVENTION

1. Field of the Invention

The present invention relates to card edge connectors, more particularly to card edge connectors for mating with a memory card.

2. Description of Related Art

Card edge connectors are widely employed in computer device to receive a memory card, such as serial DDR3 and serial DDR4. The connector usually has an elongated housing, a plurality of contacts retained in the housing for electrically connecting a corresponding memory card, and two ejectors at both ends thereof for locking the memory card. The housing has a pair of sidewalls and a central slot for receiving the memory card. Each side wall defines a plurality of passageways extending therethrough. The passageways communicate with the center slot. The contacts are arranged in two rows retained in the passageways of two side walls respectively, and the contacts extend into the center slot to sandwich the memory card and ensure the electronic contact with the card. The memory card has a pair of notches at a middle position of two side edges thereof. The ejectors has a lock portion at an upper side thereof for locking the notches respectively to keep a stable working state, and an ejecting portion at a lower side thereof for ejecting the memory card to a convenient replacement.

With the development of the electronic industry, the number of the gold fingers increases to broaden the signal transmission channel and improve the signal transmission speed. Of course, the number of the contacts in the card edge connector increase codependent. When the memory card is inserted into the connector, it need overcome a big insertion force to insert the memory card into the central slot, therefore, we could not be aware of whether the card is in place or not, and it always makes inconvenience and confuse for users.

Hence, an improved card edge connector is desired to overcome the above problems.

BRIEF SUMMARY OF THE INVENTION

An object of the present invention is to provide a card edge connector with detecting function because of added detecting structure.

In order to achieve the above-mentioned object, a card edge connector for mating with a memory card according to the present invention, comprises: an elongate insulative housing defining a pair of opposed side walls, a central slot between the side walls; a plurality of contacts retained in the insulative housing and each having a mating portion extending into the central slot; and at least a ejector rotatably attached to the housing, and the ejector is moveable between locking station and release station; the connector at least has a first detect pin and a second detect pin, and the detecting contacts have spring and are moveable relatively each other. The first detect pin and the second detect pin define a first contact portion and a second contact portion respectively, and the first detect pin or the second detect pin defines an engaging portion protruding into an inserting slot of the insulative housing for engaging with a bottom edge of the memory card and pushing the first and the second contact portion to connect disconnect with each other. Furthermore LED is combined with the detecting contacts for testing if the memory card is inserted in the connector or not.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
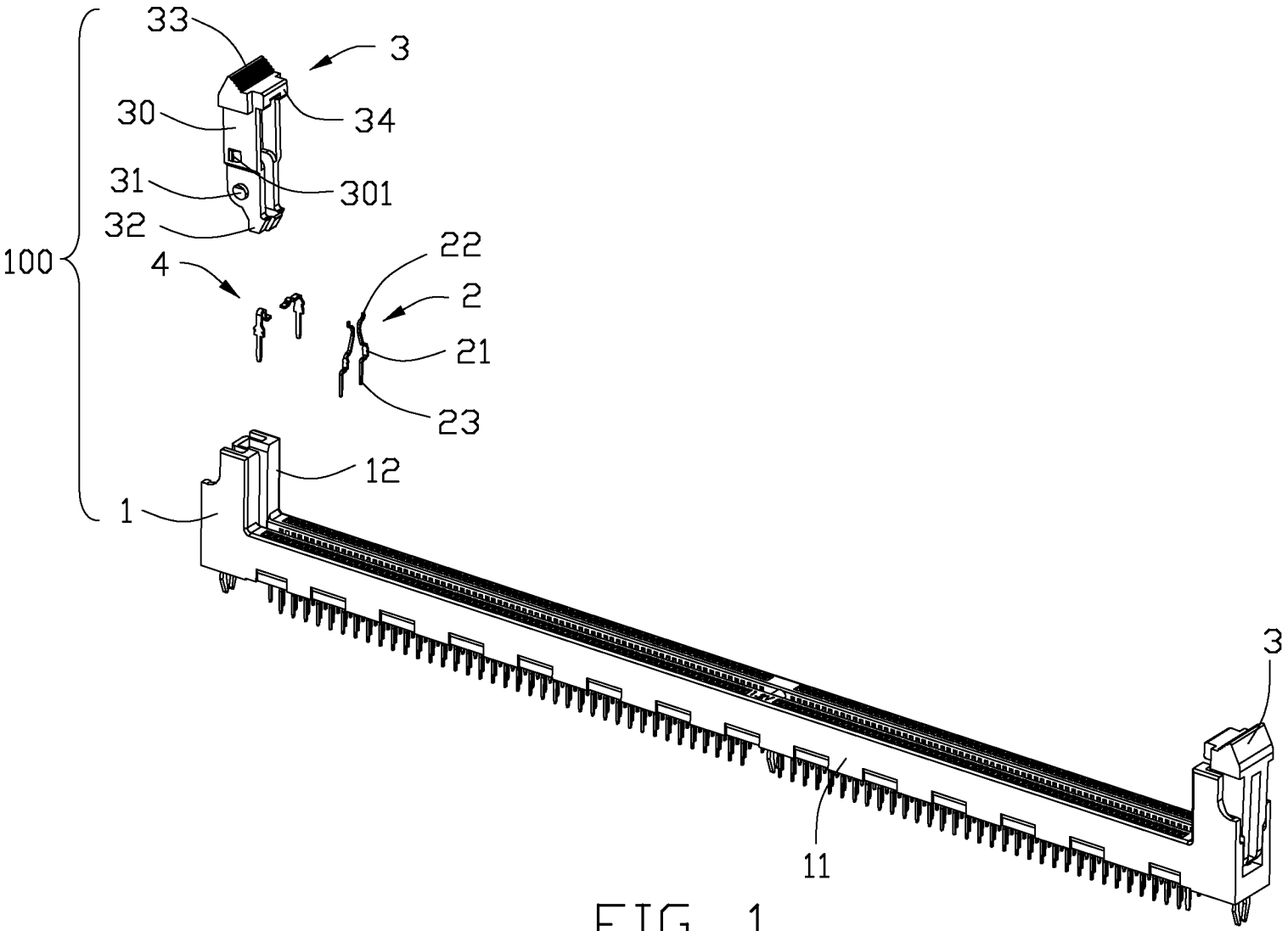
FIG. 1 is a perspective view and a partially exploded view of a card edge connector according to a first aspect of the present invention.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-6, according to a first aspect of the present invention, a card edge connector 100 is adapted to be mounted on a printed circuit board (PCB) (not shown) and then engage with a memory card 200 for interconnecting between both thereof. The card edge connector 100 comprises an elongate insulative housing 1, a plurality of contacts 2 retained in the insulative housing 1, a pair of ejectors 3 retained on two opposed ends of the insulative housing 1, and at least a pair of detecting contacts 4 retained in the insulative housing 1.

The insulative housing 1 has a pair of opposed sidewalls 11 extending upwardly from a bottom wall and located in a width direction thereof and a pair of tower portions 12 upwards integrally protruding from both ends of the sidewalls 11, thereby forming an inserting slot 101 for receiving the memory card 200. The tower portion 12 has a receiving opening for receiving the ejector or latch 3. The ejector 3 is mounted into the receiving opening and includes a base portion 30, a pair of rotating shafts 31 protruding from both sides of the base portion 30 and pivoting in a pair of shaft hole (not shown) formed in the tower portion 12, a pair of protrusions 301 formed on both sides of the base portion 30, a pushing portion 32 (refer to FIG. 6) extending towards the insertion slot 101 from one end of the base portion 30 in the opening station for pushing the memory card 200 outwardly, an operating portion 33 disposed at distal end of the ejector 3 and a locking portion 34 disposed at opposite end of the operating portion 33 and extending towards the insertion slot 101 from another end of the base portion 30 for locking the memory card 200.

The insulative housing 1 defines a plurality of receiving grooves 110 for receiving the contacts 2 therein. The contacts 2 are arranged in two arrays along a longitudinal direction, while opposite to each other in the width direction, respectively being disposed at both sidewalls 11. Each of the contacts 2 includes a retaining portion 21 retained in the insulative housing 1, a contacting arm 22 extending into the inserting slot 101 upwardly from one end of the retaining portion 21 and having a protecting portion 221 engaging on receiving grooves 110 for limiting the contacting arm 22 moving overly and a mating portion 222 for contacting with the memory card and a soldering tail 23 extending outwards from another end of the retaining portion 21 for being soldered to the PCB. The detecting contacts 4 are retained in the bottom wall of the insulative housing 1 and protruding upwardly into the inserting slot 101. According to the present aspect of the invention, the detecting contacts 4 are distributed near the tower portion 12 and located at outside of the contacts 2 for optimizing the space and do not need enlarge the present card edge connector 100 to provide extra space for the detecting contacts 4.

Figure 3:
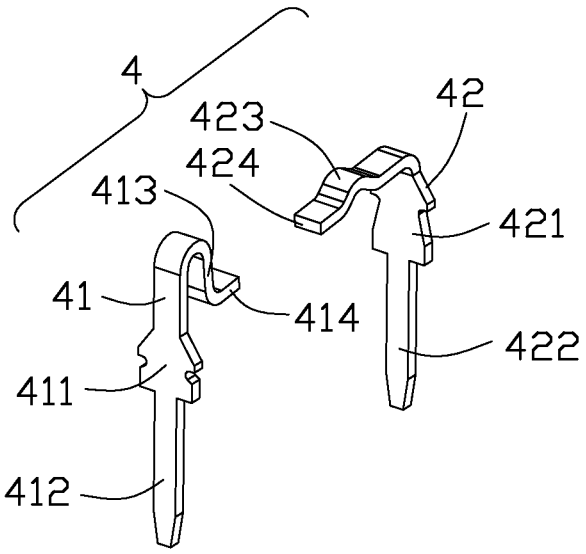
FIG. 3 is a perspective view of a pair of detecting contacts of the card edge connector shown in FIG. 1.
Figure 4:
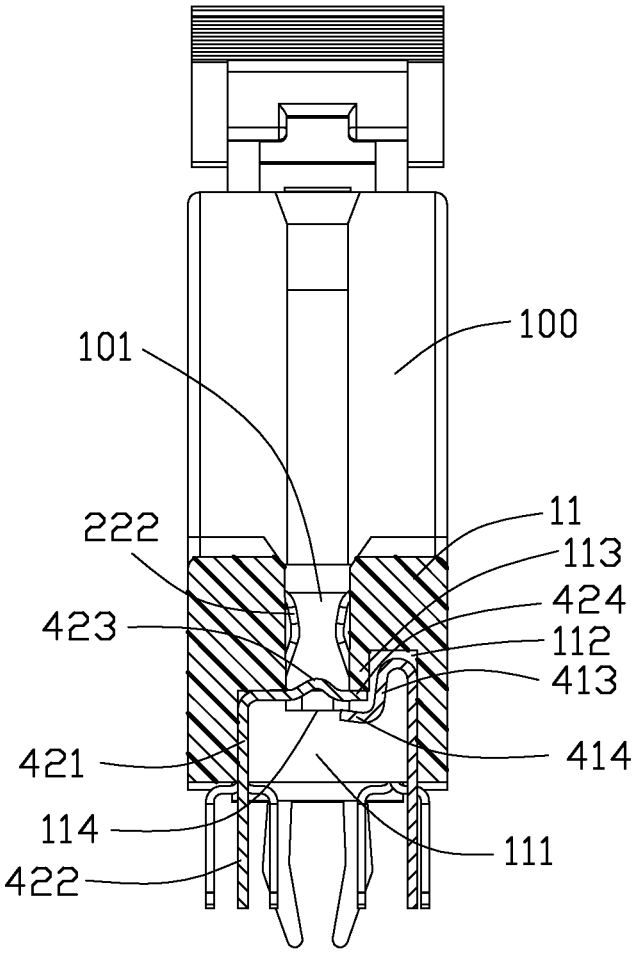
FIG. 4 is a cross section view of the card edge connector taken along a broken line 4-4 in FIG. 2.
Figure 5:
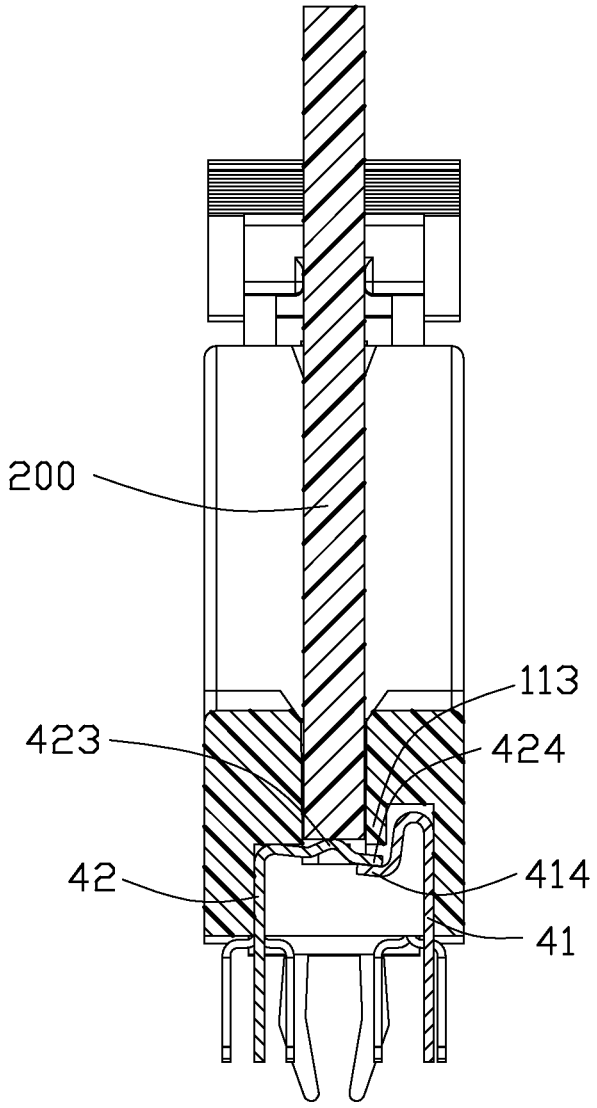
FIG. 5 is a cross section showing a memory card inserted into the card edge connector.

Referring to FIGS. 3-5, the pair of detecting contacts 4 includes a first detecting pin 41 and a second detecting pin 42 both received in a corresponding receiving slot 111 formed in the insulative housing 1 and passes through the bottom wall and communicates with the inserting slot 101 upwardly. The first detecting pin 41 and the second detecting pin 42 are both bended from metal strips and are spring for being capable of engaging or disengaging with each other. The first detecting pin 41 includes a retaining portion 411 received in the insulative housing 1, a soldering portion 412 extending outwards from one end of the retaining portion 411 for being soldered to the PCB, a bending portion 413 bending from the another end of the retaining portion 411 and a first contact portion 414 extending from the bending portion 413 for contacting with the second detecting pin 42. The second detecting pin 42 includes a retaining portion 421 received in the insulative housing 1, a soldering portion 422 extending outwards from one end of the retaining portion 421 for being soldered to the PCB, an engaging portion 423 bending from the another end of the retaining portion 421 and extending into the inserting slot 101 for being pressed by the memory card 200, and a second contact portion 424 extending from the engaging portion 423 for contacting with the first detecting pin 41.

The bending portion 413 of the first detecting pin 41 presents as a reverse U shape. The receiving slot 111 includes a groove 112 formed in the sidewall 11 of the insulative housing 1 for receiving the bending portion 413, and a stopper portion 113 positioned against the bending portion 413 for restricting the bending portion 413 in the positioning groove 112 and protecting the first detecting pin 41 from tilting for an excessive elastic deformation. The first contact portion 414 of the first detecting pin 41 is below the second contact portion 424 of the second detecting pin 42, and they are disengaging with each other before the memory card 200 being inserted. The second contact portion 424 is spring for being capable of deforming upwards, and it abuts below the stopper portion 113 which could protect the second contact portion 424 from an excessive elastic deformation upwards.

The engaging portion 423 and the second contact portion 424 of the second detecting pin 42 are higher than the bottom surface 114 of the inserting slot 101 and the first contact portion 414 of the first detecting pin 41 is positioned below the inserting slot 101 to provide enough space for the second detecting pin 42 floating. The engaging portion 423 is higher than the second contact portion 424 for engaging with the memory card 200. When the memory card 200 is inserted into the inserting slot 101, the memory card 200 pushes downwards the engaging portion 423 which moves and drives the second contact portion 424 engage with the first contact portion 414.

The PCB defines an LED light which electrically connects with the first detecting pin 41 and the second detecting pin 42, thereby forming a series circuit or a parallel circuit. If it is a series circuit, the first detecting pin 41 and the second detecting pin 42 form a switch controlling the LED light off or on. When the first detecting pin 41 and the second detecting pin 42 are connected, the LED light is turn on for telling user the memory card 200 is inserted. Otherwise the LED light is turn off for telling user the memory card 200 is taken out. If it is a parallel circuit, the first detecting pin 41 and the second detecting pin 42 are disposed on one divided circuit and work as a switch for making the LED light disposed on the other divided circuit be short or not, then controlling the LED light be on or off.

Figure 2:
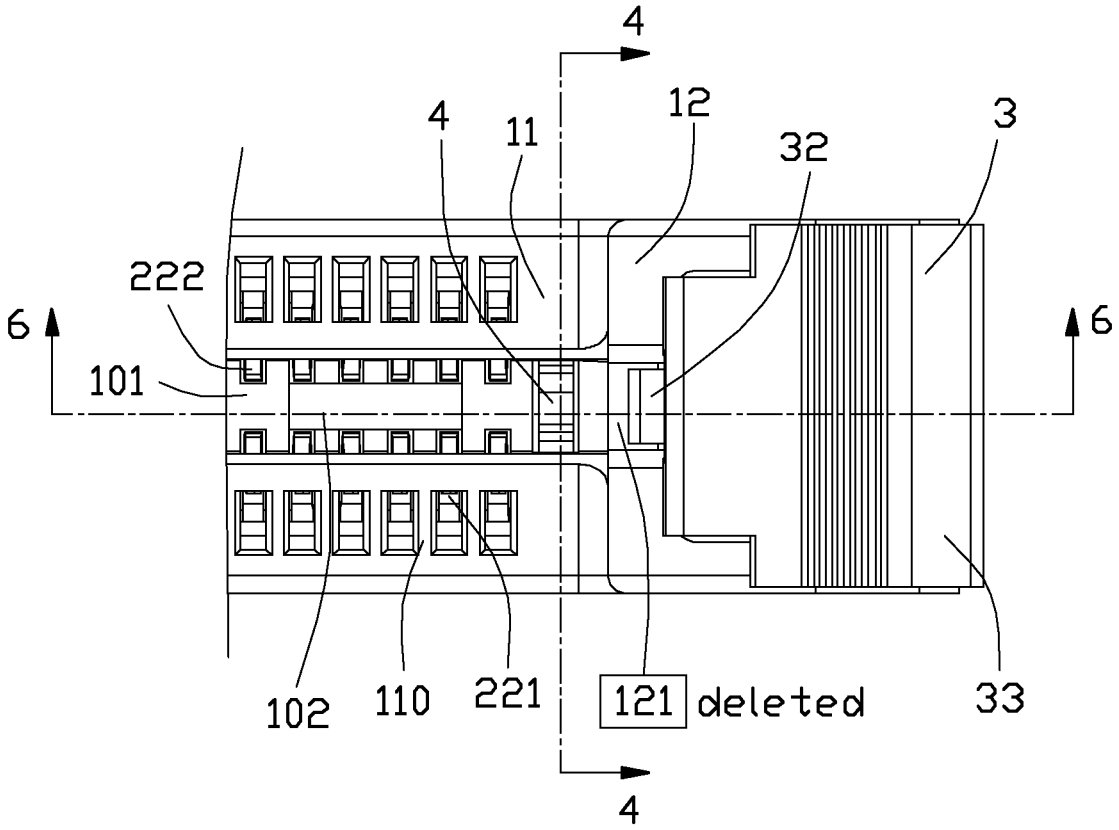
FIG. 2 is a partially top view of the card edge connector shown in FIG. 1.
Figure 6:
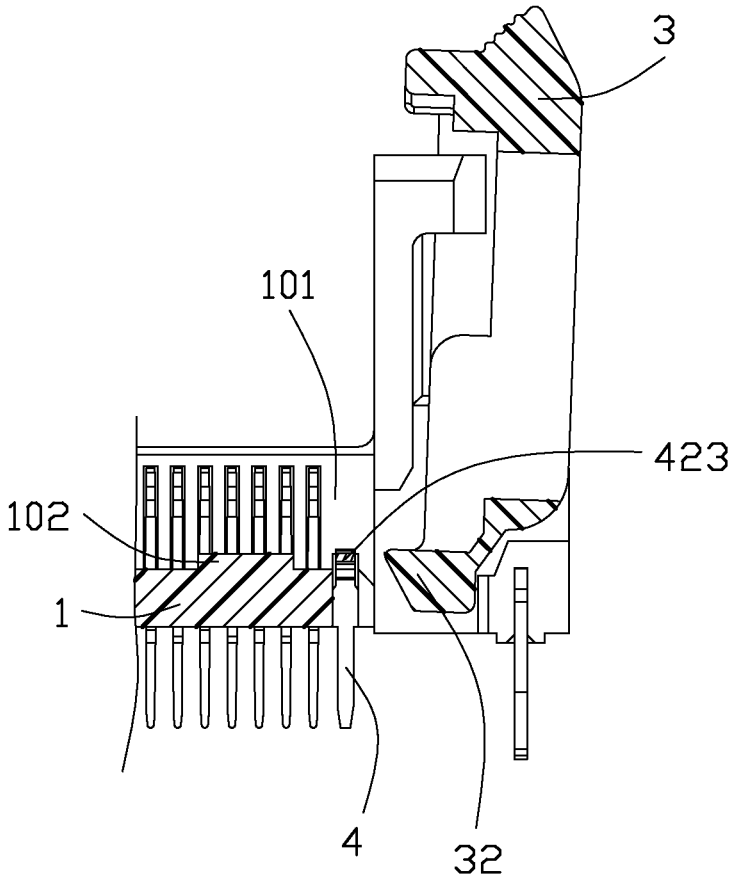
FIG. 6 is a cross section view of the card edge connector taken along a broken line 6-6 in FIG. 2.
Figure 7:
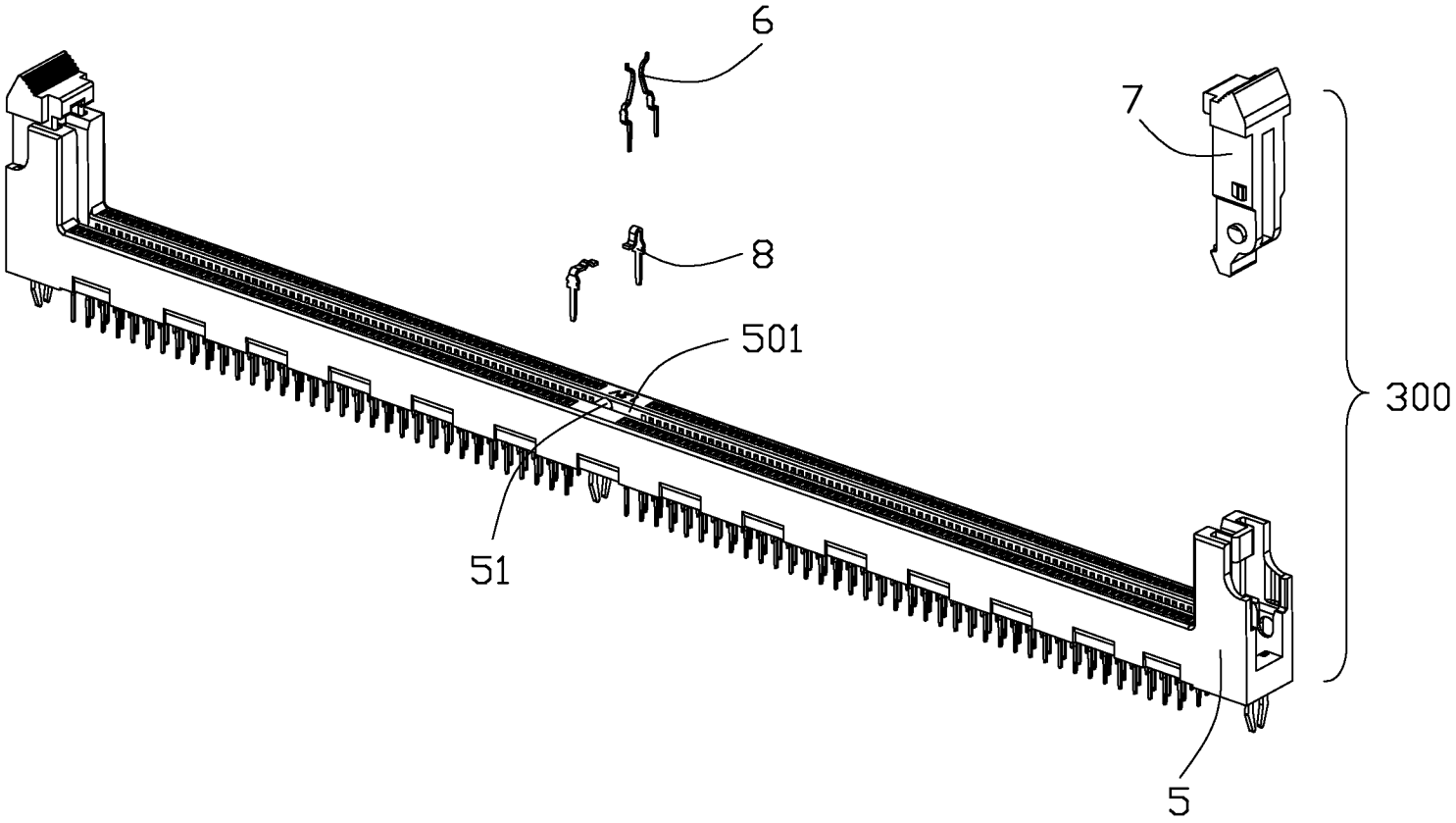
FIG. 7 is a perspective view and a partially exploded view of a card edge connector according to a second aspect of the present invention.
Figure 8:
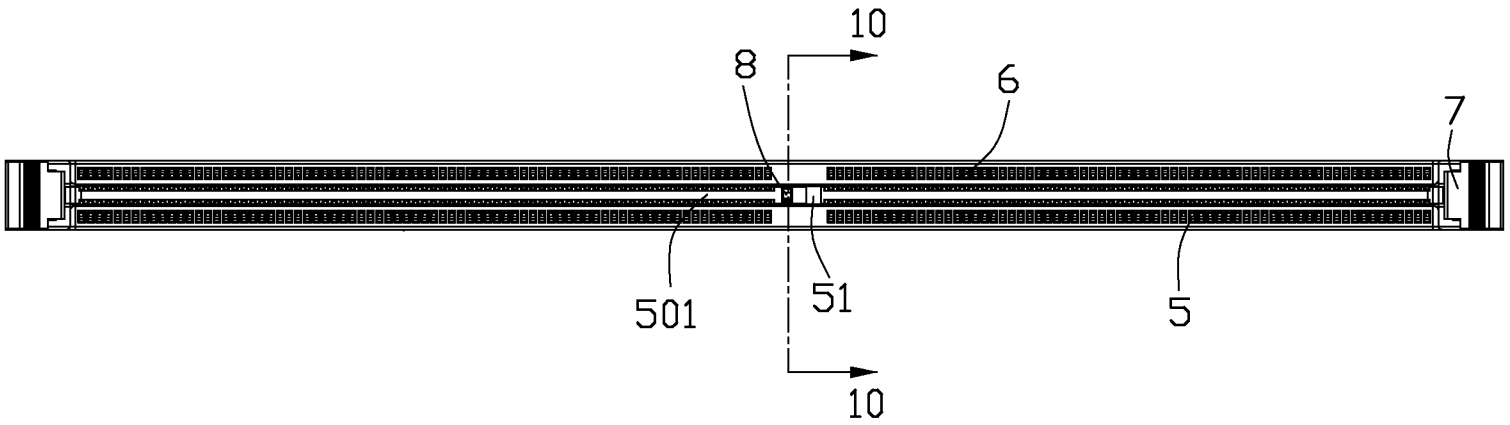
FIG. 8 is a top view of the card edge connector shown in FIG. 7.
Figure 9:
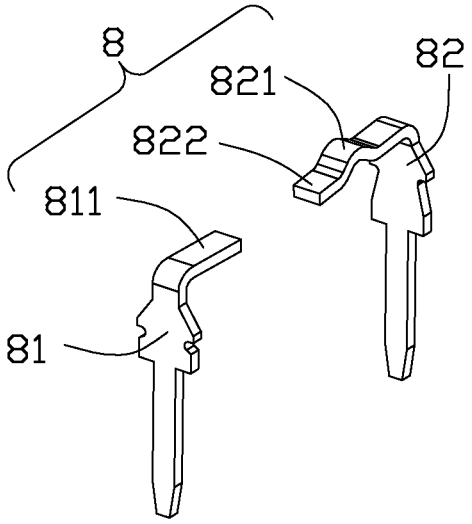
FIG. 9 is a perspective view of a pair of detecting contacts of the card edge connector shown in FIG. 7.
Figure 10:
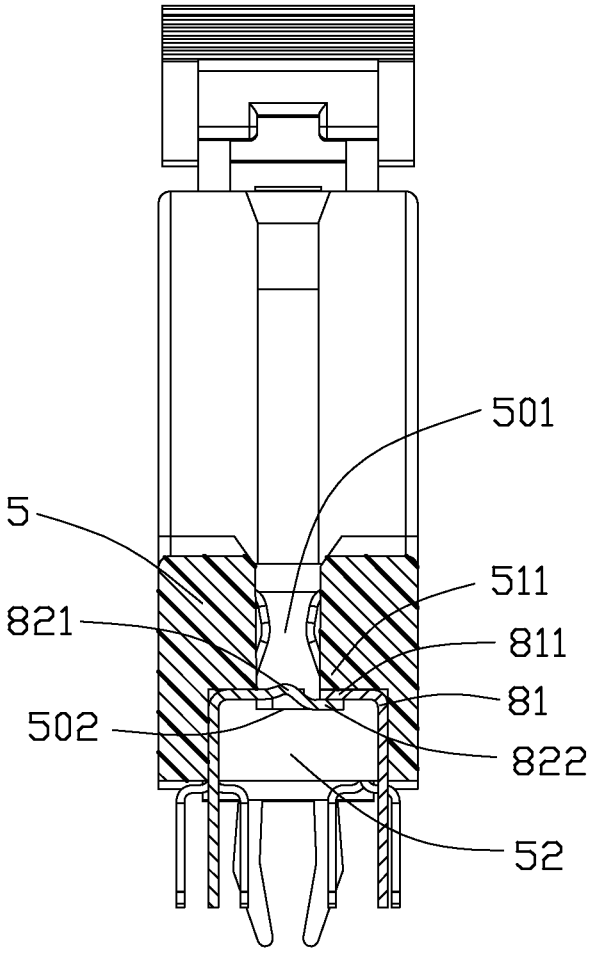
FIG. 10 is a cross section view of the card edge connector taken along a broken line 10-10 in FIG. 8.
Figure 11:
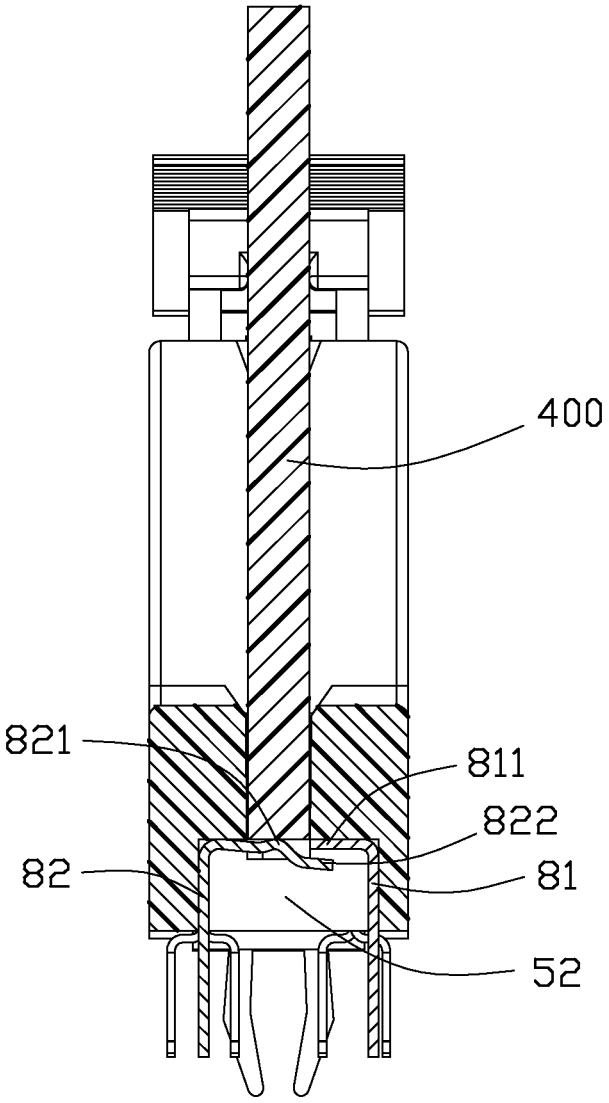
FIG. 11 is a cross section showing a memory card inserted into the card edge connector.

Referring to FIGS. 2 and 6, according to the present aspect of the invention, the memory card 200 could be a DDR4 card. Different from the DDR3 card, the DDR4 card (not shown) has more terminals retained at a lower edge thereof for extending the memory space and improving the transmission rate, and the middle part of the lower edge thereof protrudes from the lower edge for a lower inserting resistance force. According to the present aspect of the invention, the both ends of the insulative housing 1 in the longitudinal direction form two step portions 102 at the bottom of the inserting slot 101. The step portions 102 mate with the recesses (not shown) formed on the bottom edge of the DDR4 card, and prevent the DDR4 card from shocking or vibrating. The engaging portion 423 of the second detecting pin is higher than the step portion 102 to make sure the memory card still could press the engaging portion 423.

Referring to FIGS. 7-11, according to a second aspect of the invention, a card edge connector 300 comprises an elongate insulative housing 5, a plurality of contacts 6 retained in the insulative housing 5, a pair of ejectors 7 retained on two opposed ends of the insulative housing 5, and at least a pair of detecting contacts 8 retained in the insulative housing 5. The structure and the position is different from the first aspect of the invention, and description will be made to describe the difference in detail.

The insulative housing 5 has an inserting slot 501 for receiving the memory card 400, and a key 51 protruding into the inserting slot 501 for engaging with a notch (not shown) at bottom of the memory card 400. The pair of detecting contacts 8 positioned adjacent to the key 51 and retained in the bottom wall of the insulative housing 5 for saving the space the pair of detecting contacts 8 occupied.

The pair of detecting contacts 8 includes a first detecting pin 81 and a second detecting pin 82 both received in a receiving slot 52 of the insulative housing 5. The receiving slot 52 communicates with the inserting slot 501 for realizing the contact between the pair of detecting contacts 8 and the memory card 400, and it defines a stopper portion 511 positioned against the first detecting pin 81 for restricting the movement of the first detecting pin 81. The first detecting pin 81 formed as a reverse L shape, and it includes a soldering portion extending outwards from one end of the detecting pin 81 for being soldered to a PCB (not shown) and a first contact portion 811 from the another end of the detecting pin 81 for contacting with the second detecting pin 82. The second detecting pin 82 is similar to the one mentioned in the first aspect of the invention, and it includes a soldering portion extending outwards from one end thereof for being soldered to the PCB, an engaging portion 821 bending from the another end thereof and extending into the inserting slot 501 for being pressed by the memory card 400, and a second contact portion 822 extending from the engaging portion 821 for an electronic contact with the first contact portion 811. The second contact portion 822 is spring for being capable of deforming downwards and abutting below the first contact portion 811. The first contact portion 811 protects the second contact portion 822 from an excessive elastic deformation upwards.

The first contact portion 811 and the second contact portion 822 contact with each other before the memory card 400 is inserted into the inserting slot 501. The second contact portion 822 is positioned below the first contact portion 811, and it is convenient for the second contact portion 811 leave the first contact portion 811 with the engaging portion 821 when the engaging portion 821 is pressed. The engaging portion 821 of the second detecting pin 82 is higher than the bottom surface 502 of the inserting slot 501 to provide enough space for the second detecting pin 82 drifting, and the engaging portion 821 is higher than the second contact portion 822 for engaging with the memory card 400. When the memory card 400 is inserted into the inserting slot 501, the memory card 400 pushes downwards the engaging portion 821 which moves and drives the second contact portion 822 leave the first contact portion 811.

As the first aspect of the invention, the PCB defines an LED light which electrically connects with the first detecting pin 81 and the second detecting pin 82, thereby forming a series circuit or a parallel circuit. If it is a series circuit, the first detecting pin 81 and the second detecting pin 82 form a switch controlling the LED light off or on. When the first detecting pin 81 and the second detecting pin 82 are connected, the LED light is turn on for telling user the memory card 400 is not inserted. Otherwise the LED light is turn off for telling user the memory card 400 is inserted. If it is a parallel circuit, the first detecting pin 81 and the second detecting pin 82 are disposed on one divided circuit and work as a switch for making the LED light disposed on the other divided circuit be short or not, then controlling the LED light be on or off. When the first detecting pin 81 and the second detecting pin 82 are connected, the LED light is turn off for telling user the memory card 400 is not inserted. Otherwise the LED light is turn on for telling user the memory card 400 is inserted.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A card edge connector for engaging with a memory card, comprising:

a longitudinal insulative housing includes an inserting slot for receiving the memory card and a receiving opening communicating with the inserting slot;

a plurality of contacts retained in the insulative housing, and each of the contacts having a mating portion extending into the inserting slot for contacting with the memory card; and at least one pair of detecting contacts comprising a first detecting pin and a second detecting pin received and retained in a receiving slot formed in the insulative housing;

wherein the second detecting pin comprises a spring engaging arm having an engaging portion protruding into the inserting slot and adapted to be pushed downwards by a bottom edge of the memory card, and a second contact portion located on a distal end of the spring engaging arm along the engaging portion and at a different level with regard to the engaging portion; insertion of the memory card into the inserting slot makes the contact portion engaged with or disengage from the first detecting pin; wherein the first detecting pin comprises a bending portion presenting as a reverse U shape and a first contact portion disposed on distal end of the bending portion engaging with the second contact portion of the second detecting pin; wherein the receiving slot includes a positioning groove formed in the insulative housing for receiving the bending portion, and a stopper portion positioned against the bending portion of the first detecting pin.

2. The card edge connector as described in claim 1, wherein the second contact portion is spring for being capable of deforming upwards, and it abuts below the stopper portion.

3. The card edge connector as described in claim 2, wherein the engaging portion and the second contact portion of the second detecting pin are higher than a bottom surface of the inserting slot and the first contact portion of the first detecting pin is positioned below the inserting slot to provide enough space for the second detecting pin floating.

4. A card edge connector for use with a memory module having a pair of side notches thereof, comprising:

an insulative housing defining an elongated insertion slot extending along a longitudinal direction for receiving the memory module;

two rows of contacts disposed in the housing and respectively located by two sides of the insertion slot in a transverse direction perpendicular to said longitudinal direction, each of said contacts including a resilient transversely deflectable contacting sections extending into a middle portion of the insertion slot;

a pair of latches located at two opposite longitudinal ends of the housing in said longitudinal direction for latching into the corresponding notches of the memory module; and a pair of detecting contacts disposed in the housing and including a first detecting pin and a second detecting pin disposed in the housing, the second detecting pin including a downwardly deflectable spring arm extending around a lower side of the insertion slot and adapted to be abutted against by a bottom edge of the memory module when said memory module is fully received in the insertion slot; wherein said spring arm of the second detecting pin and said first detecting pin are either mechanically and electrically connected with each other depending upon whether the spring arm is downwardly deflected due to full insertion of the memory module into the insertion slot so as to form a switch mechanism.

5. The card edge connector as claimed in claim 4, wherein the spring arm extends along the transverse direction.

6. The card edge connector as claimed in claim 4, wherein the first detecting pin and the second detecting pin are located by two sides of the insertion slot, respectively.

7. The card edge connector as claimed in claim 4, wherein the spring arm of the second detecting pin is electrically and mechanically connected to the first detecting pin only when the memory module is fully inserted into the insertion slot and the spring arm is downwardly deflected.

8. The card edge connector as claimed in claim 4, wherein said spring arm of the second detecting pin is electrically and mechanically connected to the first detecting pin only when no memory module is fully inserted into the insertion slot and the spring arm is not downwardly deflected.

9. The card edge connector as claimed in claim 4, wherein the housing defines a common receiving slot across the lower side of the insertion slot, and the first detecting pin and the second detecting pin are located by two opposite sides of the receiving slot in the transverse direction.

10. The card edge connector as claimed in claim 4, wherein said spring arm of the second detecting pin defines an upward bulged section upwardly extending into the insertion slot.

11. The card edge connector as claimed in claim 4, wherein a free end of said spring arm and a retaining section of the second detecting pin are located by two sides of the insertion slot in said transverse direction.

12. A card edge connector for use with a memory module having a pair of side notches thereof, comprising:

an insulative housing defining an elongated insertion slot extending along a longitudinal direction for receiving the memory module which is adapted to be inserted into the insertion slot in a vertical direction perpendicular to said longitudinal direction;

two rows of contacts disposed in the housing and respectively located by two sides of the insertion slot in a transverse direction perpendicular to both said longitudinal direction and said vertical direction, each of said contacts including a resilient transversely deflectable contacting sections extending into a middle portion of the insertion slot;

a pair of towers located at two opposite ends of the housing in said longitudinal direction;

a pair of latches located respectively in the corresponding towers, each of said latches including an upper locking portion for latching into the corresponding notch of the memory module and a lower pushing portion for upwardly pushing the memory module out of the insertion slot in the vertical direction; and a detecting pin disposed around one of said towers and adjacent to the lower pushing portion of the corresponding latch, and including a downwardly deflectable spring arm extending along said transverse direction and deflectable in the vertical direction around a lower side of the insertion slot and adapted to be abutted against by a bottom edge of the memory module when said memory module is fully received in the insertion slot.

13. The card edge connector as claimed in claim 12, wherein said detecting pin has a solder portion extending downwardly below the housing and is located not right under the insertion slot by one side of the insertion slot.

14. The card edge connector as claimed in claim 13, further including another detecting pin neighboring the first detecting pin, wherein said another detecting pin includes an upper contacting portion adapted to be connected to the spring arm, and a lower soldering portion which is located by the other side of the insertion slot opposite to the solder portion of said detecting pin in said transverse direction.

15. The card edge connector as claimed in claim 12, wherein said pair of latches are pivotally mounted to the housing.

16. The card edge connector as claimed in claim 15, wherein a pivot axis of each of said latches extends in the transverse direction.

* * * * *